United States Patent [19]

Gofflot

[11] 4,136,640

[45] Jan. 30, 1979

[54] CATTLE SQUEEZE GATE

[76] Inventor: Armand Gofflot, R.R. #1, Pipestone, Canada, R0M 1T0

[21] Appl. No.: 774,803

[22] Filed: Mar. 7, 1977

[30] Foreign Application Priority Data

Apr. 15, 1976 [CA] Canada ..... 250383

[51] Int. Cl.[2] ..... A61D 3/00

[52] U.S. Cl. ..... 119/99

[58] Field of Search ..... 119/98, 99, 103

[56] References Cited

U.S. PATENT DOCUMENTS

| | | | |
|---|---|---|---|
| 1,621,760 | 3/1927 | Stader et al. | 119/99 X |
| 3,221,707 | 12/1965 | Pearson | 119/98 |
| 4,027,629 | 6/1977 | Pearson | 119/99 |

*Primary Examiner*—Hugh R. Chamblee

*Attorney, Agent, or Firm*—Stanley G. Ade

[57] ABSTRACT

Two gate sides are pivoted within a base for substantial parallel swinging movement towards and away from one another by means of a handle on one support post of the components. A cross-over chain at the other ends of said support posts transfers movement of one gate side with the other. The handle incorporates a locking mechanism which is disengaged when the handle is lifted for gate side movement but is engaged when the handle is lowered thus maintaining the gate side lock in position.

12 Claims, 7 Drawing Figures

CATTLE SQUEEZE GATE

BACKGROUND OF THE INVENTION

This invention relates to new and useful improvements in squeeze gate assemblies used for cattle normally in conjunction with a head gate assembly at one end thereof.

Many squeeze gates exist, but all suffer from disadvantages some of which include the fact that the movement of the squeeze gates lifts the cattle from the ground, operation of the squeeze gates frightens the cattle with the possibility of damage occurring to the cattle.

Other disadvantages include inefficient locking devices which not only are difficult to operate, but do not permit the squeeze gate sides to be swung open clear of the animal so that it may readily be disengaged from the chute.

SUMMARY OF THE INVENTION

The present invention overcomes these disadvantages by providing a quietly operating, easily actuated, squeeze gate in which the two sides move parallel to one another, either towards or away from each other with a simple handle operation.

The handle incorporates a self-locking assembly which, when the handle is raised to move the gate, disengages the assembly and which engages the assembly thus locking the gate, when the handle is lowered.

Another advantage of the present invention is that the two gates move towards or away from one another merely by actuating one side thereof, a cross-over chain assembly transferring similar motion to the opposite gate.

Another advantage of the present construction is that the gates are mounted on links attached to the base frame and the rear links can readily be detached so that the gate sides may swing open hinging around the front linkage thus enabling the chute to be opened fully merely by pulling the pins securing the rear linkage.

A still further object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
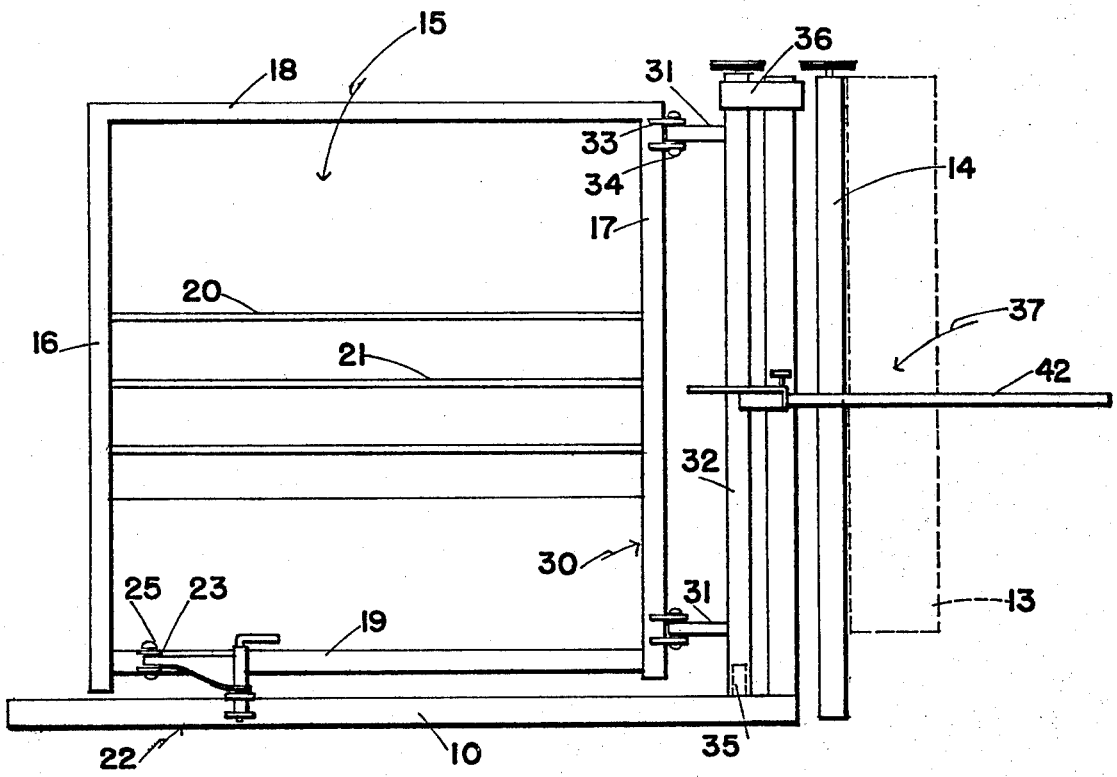
FIG. 1 is a side elevation of the squeeze chute showing the gates in the opened position.

Proceeding therefore to describe the invention in detail, reference character 10 illustrates a base frame which consists of a pair of spaced and parallel members 11 extending longitudinally and having a rear cross bar 12 extending therebetween. A head gate assembly 13 is situated at the front end of the base frame and extends upwardly therefrom but as this does not form part of the present invention, it is not believed necessary to disclose details thereof except to say that the assembly enables an animal within the chute to be engaged around the neck in the usual manner.

The head gate assembly includes a pair of spaced and parallel vertical members 14 which are preferably but not necessarily, tubular members extending upwardly from the front ends of the longitudinally extending base frame members 11.

A pair of squeeze gates collectively designated 15 are provided and are pivotally secured to the base frame for movement towards and away from one another as will hereinafter be described.

Each component 15 is substantially rectangular when viewed in side elevation and includes a rear vertical member 16, a front vertical member 17 and upper and lower horizontal members 18 and 19 with horizontal cross braces 20 being provided where necessary. The plywood panel or the like 21 may fill in the bottom portion of the open rectangular component 15.

Figure 4:
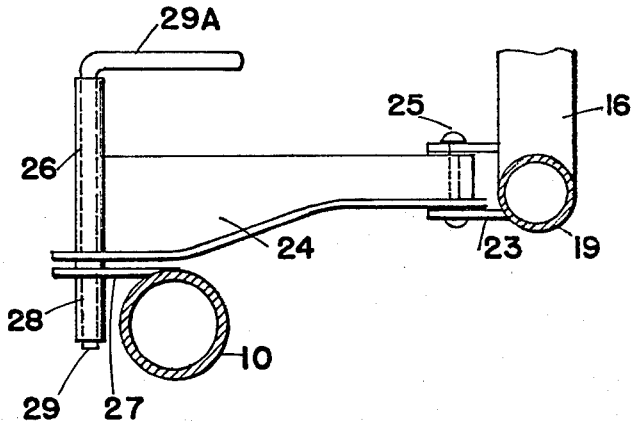
FIG. 4 is an enlarged fragmentary side elevation showing the preferred embodiment of the rear hinging mechanism.

Linkage secures the gate component 15 to the base frame 10 and dealing first with the rear linkage collectively designated 22, a pair of spaced and parallel side plates 23 are welded towards the rear end of the lower horizontal member 19 of the component 15 within which a link 24 is pivotally secured by means of pivot pin 25. The link 24 is shown in detail in FIG. 4 and consists of a cranked member, the outer end of which is secured to a vertical sleeve 26.

A plate 27 is welded to the base member 10 adjacent the rear end thereof and includes a tubular portion 28 welded to the underside thereof.

A pivot pin 29 detachably engages through the tubular member 26 and into the tubular member 28 thus detachably securing the link to the base frame member 10, but enabling same to swing free if the pivot pin 29 is removed, and in this connection the upper end of the pivot pin is angulated to form a handle portion 29A.

Figure 5:
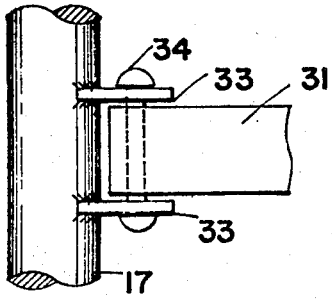
FIG. 5 is an enlarged fragmentary view showing the pivotal connection of the front linkage attachment to the gate.

The front linkage collectively designated 30 includes upper and lower link arms 31 secured to a vertical support member 32 as by welding and extending outwardly therefrom. Pairs of plates 33 are welded to the front vertical member 17 of the gate component and pivot pins 34 pivot the distal ends of the link arms 31 within the pairs of plates 33 as clearly shown in FIG. 5.

The vertical support member 32 is preferably tubular and engages over the lower end bearing member 35 and is supported for rotation within a strap bearing 36 secured adjacent the upper end of the support 14 and extending rearwardly therefrom as clearly shown in FIG. 1.

Figure 3:
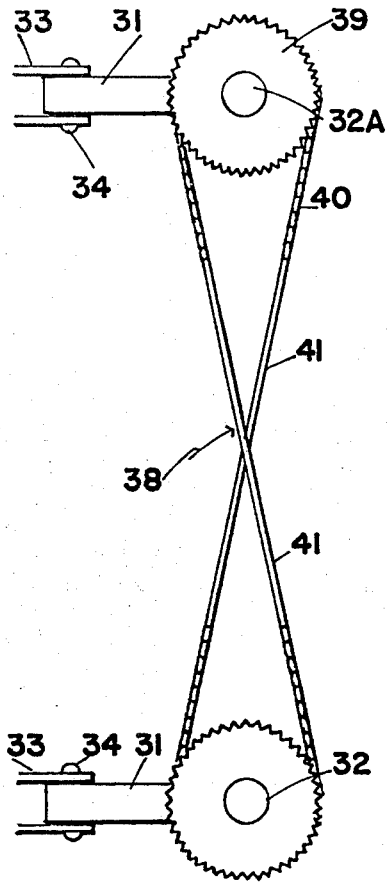
FIG. 3 is an enlarged fragmentary top plan view showing the interconnection between the two gates.

Means are provided to partially rotate one of the support members 32 within its bearings, taking the form of a handle assembly 37 hereinafter to be described and further means collectively designated 38 are provided to transfer the motion of one of the support members 32 to the other 32A and hence movement of one gate component 15 to the other gate component 15A and details of this action are shown in FIG. 3.

A sprocket gear or wheel 39 is secured to the upper end of each of the support members 32 and 32A and an endless sprocket chain assembly 40 extends around the sprockets as clearly illustrated with the assembly being crossed intermediate the sprockets so that the sprockets rotate in opposite directions one to the other. This assembly 40 can be continuous length of chain, but preferably solid central rod portions 41 are preferred where the assembly crosses over in order to prevent any locking up of the assembly from occurring.

Referring back to the handle assembly 37, this includes the elongated handle 42 pivoted for movement within a vertical plane by the inner end thereof, within a portion 43 secured to and extending from one of the support members 32.

Figure 7:
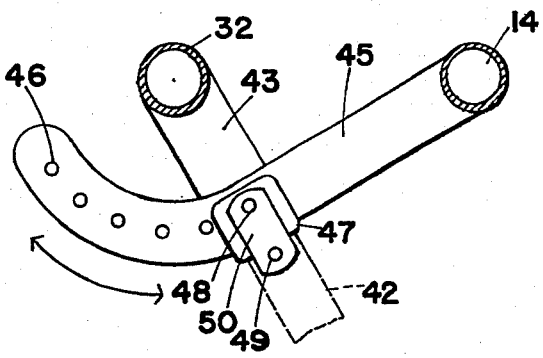
FIG. 7 is a top plan view of FIG. 6 substantially along the line 7—7 of FIG. 6.

A lock means or assembly is provided collectively designated 44 and takes the form of a quadrant 45 secured by one end thereof to the support 13 and curving around the support member 32. A plurality of apertures 46 is formed through this quadrant as clearly shown in FIG. 7.

Figure 6:
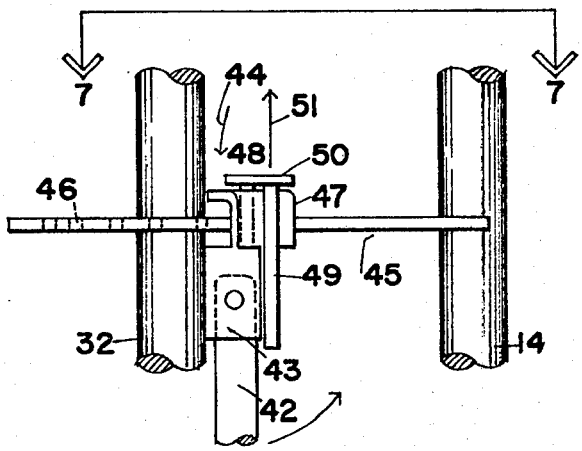
FIG. 6 is an enlarged fragmentary side elevation showing the lock assembly.

A curved guide 47 extends upwardly from the portion 43 and over the quadrant 45 and supports a relatively short pin 48 for vertical sliding movement and this pin is positioned so that it may engage any of the apertures 46 within the quadrant 45 when it is in the lowermost position as illustrated in FIG. 6.

A relatively long pin 49 is also provided and pins 48 and 49 are connected together by a connector link 50 and pin 49 extends downwardly just clear of the portion 43 to which handle 42 is pivoted.

The relatively long pin 49 is positioned so that it is engaged by the handle when the handle is raised to the horizontal or operating position shown in FIG. 1 and this raises pin 49 upwardly in the direction of arrow 51 together with short pin 48 and link 50 thus disengaging the short pin 48 from the quadrant and allowing the support member 32 to be rotated by means of the handle 42.

Figure 2:
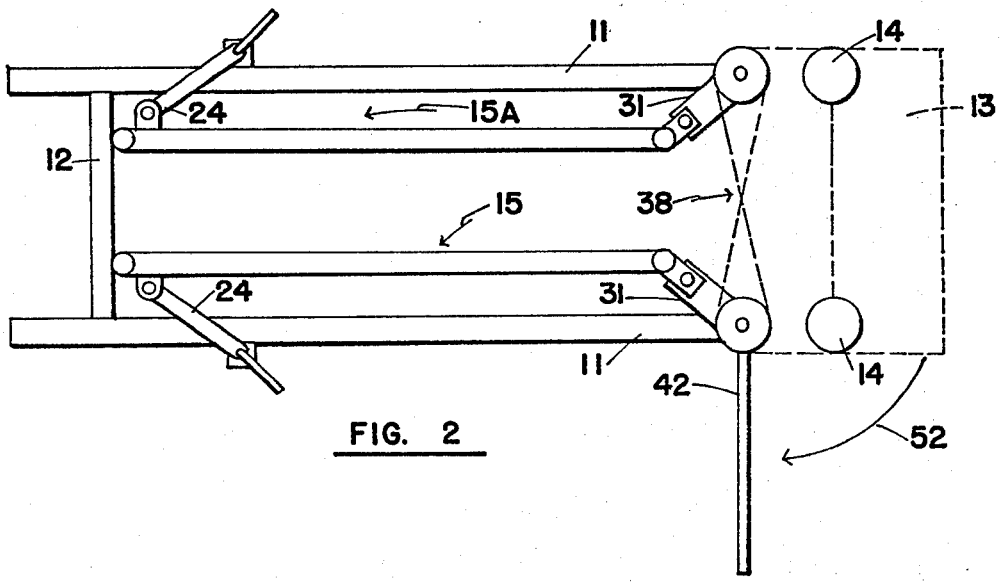
FIG. 2 is a top plan view of FIG. 1, but showing the gates in the squeezed or closed position.

Movement of the handle in the direction of arrow 52 as illustrated in FIG. 2, will cause the two support members to rotate thus moving the gate components 15 and 15A inwardly towards one another to the position shown in FIG. 2 whereupon lowering of the handle 42 will enable the short pin 48 to move downwardly and engage one of the apertures 46 within quadrant 45 thus locking the squeeze gate in the desired position so that the gate components 15 and 15A cannot move outwardly relative to one another.

When it is desired to release the gate components 15 and 15A, the handle may be raised to the horizontal position thus disengaging pin 48 whereupon the handle can be moved in a direction opposite to arrow 52 thus opening the gates which of course remain substantially parallel to one another at all times due to the position of the front and rear linkage as hereinbefore described.

If desired, the animal held between the gates in the locked position, may be released merely by pulling the pivot pin 29 of the rear linkage 23 as hereinbefore described whereupon the two gate components may swing outwardly away from one another pivoting upon the pivot pins 34 of the front linkage 30. This enables the animal to be released immediately, assuming that the head gate assembly has also been released.

From the foregoing, it will be appreciated that operation of the squeeze gate assembly is easily controlled by a single operator who can also operate the head gate assembly and that the two squeeze gate components move in a parallel movement one with the other towards or away from one another thus enabling the animal to be held firmly yet released readily and rapidly.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A squeeze gate assembly in conjunction with a head gate assembly, said squeeze gate assembly comprising in combination a base frame, a pair of substantially parallel side gate components, front and rear linkage means mounting said components to said base frame for swinging action inwardly and outwardly relative to one another, actuating means for moving said components towards and away from one another, and lock means co-operating between said actuating means and said components for selectively locking said components in the desired position relative to one another, said rear link means being detachable whereby said components can swing freely outwardly from said base upon said front linkage means.

2. The assembly according to claim 1 which includes means co-operating between said gate components whereby movement of one gate component initiates corresponding movement in the other of said gate components.

3. The assembly according to claim 1 in which said rear linkage means includes a link for each component, each link being pivotally secured by one end thereof to said base frame and by the other end thereof to said component.

4. The assembly according to claim 3 which includes means co-operating between said gate components whereby movement of one gate component initiates corresponding movement in the other of said gate components.

5. The assembly according to claim 3 in which said front linkage means includes a vertical support member for each component mounted for rotation to said base frame and extending upwardly therefrom, said linkage members secured to said support member by one end thereof and being pivotally secured to the front end of said gate by the other end thereof.

6. The assembly according to claim 5 which includes means co-operating between said gate components whereby movement of one gate component initiates corresponding movement in the other of said gate components, said means including a sprocket gear secured to the upper end of each of said vertical support members, an endless sprocket chain assembly engageable around said sprocket gears, said chain assembly crossing between said sprocket gears whereby said sprocket gears rotate in opposite directions.

7. The assembly according to claim 5 in which said actuating means includes a handle pivoted by one end thereof to one of said support members for movement in a vertical plane relative thereto, said lock means including a stationary, multi-apertured plate, pin means selectively engageable within said plate, and means co-operating between said handle and said pin means to disengage said pin means from said plate when said handle is raised whereby said support member may be rotated thus moving said components relative to one another, and to engage said pin means with said plate when said handle is lowered whereby said support means and hence said components are locked in position.

8. The assembly according to claim 7 which includes means co-operating between said gate components whereby movement of one gate component initiates corresponding movement in the other of said gate components, said means including a sprocket gear secured to the upper end of each of said vertical support members, an endless sprocket chain assembly engageable around said sprocket gears, said chain assembly crossing between said sprocket gears whereby said sprocket gears rotate in opposite directions.

9. The assembly according to claim 1 in which said front linkage means includes a vertical support member for each component mounted for rotation to said base frame and extending upwardly therefrom, and linkage members secured to said support member by one end thereof and being pivotally secured to the front end of said gate by the other end thereof.

10. The assembly according to claim 9 which includes means co-operating between said gate components whereby movement of one gate component initiates corresponding movement in the other of said gate components, said means including a sprocket gear secured to the upper end of each of said vertical support members, an endless sprocket chain assembly engageable around said sprocket gears, said chain assembly crossing between said sprocket gears whereby said sprocket gears rotate in opposite directions.

11. The assembly according to claim 9 in which said actuating means includes a handle pivoted by one end thereof to one of said support members for movement in a vertical plane relative thereto, said lock means including a stationary, multi-apertured plate, pin means selectively engageable within said plate, and means co-operating between said handle and said pin means to disengage said pin means from said plate when said handle is raised whereby said support member may be rotated thus moving said components relative to one another, and to engage said pin means with said plate when said handle is lowered whereby said support means and hence said components are locked in position.

12. The assembly according to claim 11 which includes means co-operating between said gate components whereby movement of one gate component initiates corresponding movement in the other of said gate components, said means including a sprocket gear secured to the upper end of each of said vertical support members, an endless sprocket chain assembly engageable around said sprocket gears, said chain assembly crossing between said sprocket gears whereby said sprocket gears rotate in opposite directions.

* * * * *